United States Patent [19]

Douty et al.

[11] Patent Number: 4,537,454

[45] Date of Patent: Aug. 27, 1985

[54] INTERCARD-EXTRACTION MEANS

[75] Inventors: George H. Douty, Mifflintown; John M. Landis, Camp Hill; Clair W. Snyder, Jr., York, all of Pa.

[73] Assignee: AMP Incorporated, Harrisburg, Pa.

[21] Appl. No.: 516,626

[22] Filed: Jul. 25, 1983

[51] Int. Cl.[3] ..... H01R 13/62

[52] U.S. Cl. ..... 339/45 M; 339/17 M

[58] Field of Search ..... 339/45, 91 R, 17 LM, 339/17 M

[56] References Cited

U.S. PATENT DOCUMENTS

| | | | |
|---|---|---|---|
| 2,993,187 | 7/1961 | Bisbing et al. | 339/17 LM |
| 4,070,081 | 1/1978 | Takahashi | 339/91 R |
| 4,083,616 | 4/1978 | McNiece et al. | 339/45 M |
| 4,152,038 | 5/1979 | Inouye et al. | 339/91 R |
| 4,178,051 | 12/1979 | Kocher et al. | 339/45 M |
| 4,241,966 | 12/1980 | Gomez | 339/45 M |
| 4,341,428 | 7/1982 | Hatch et al. | 333/14 R |
| 4,384,754 | 5/1983 | Douty et al. | 339/17 M |
| 4,410,222 | 10/1983 | Enomoto et al. | 339/45 M |

*Primary Examiner*—Gil Weidenfeld
*Assistant Examiner*—David L. Pirlot

[57] ABSTRACT

An intercard latching extraction means is formed by a pair of members pivotally mounted at opposite ends of a dorsal rib on a connector. The members engage a rib of a header and, according to the direction of movement, act as a cam and lever to drive the connector with respect to the header.

8 Claims, 4 Drawing Figures

INTERCARD-EXTRACTION MEANS

The present invention relates to a system for interconnecting multiple closely spaced devices, such as circuit boards, and in particular to a system which aids insertion and extraction of inter-connection members in high density situations.

The current state of electronics technology requires the maximum number of inter-connects in the minimum amount of space. An example of a connector system which satisfies these requirements may be found in U.S. Pat. No. 4,384,754.

The present invention concerns a multi-plane interconnection system which includes a connector member and a header assembly mounted on a circuit board or the like. Each connector carries therein a plurality of electrical terminals each having at least one portion profiled to mate with a terminal mounted in the header assembly. The terminal of the connector can also mate with an individual conductor or a further terminal. The header assembly includes at least one header member mounted on a first side of a circuit board or the like and containing a plurality of pin terminals which are electrically and mechanically connected to circuitry on the circuit board. The subject invention comprises a latching/ejection means mounted on a dorsal rib of the connector and acting against the header and/or shroud to cause the mated latching and unmating extraction of the header.

Figure 1:
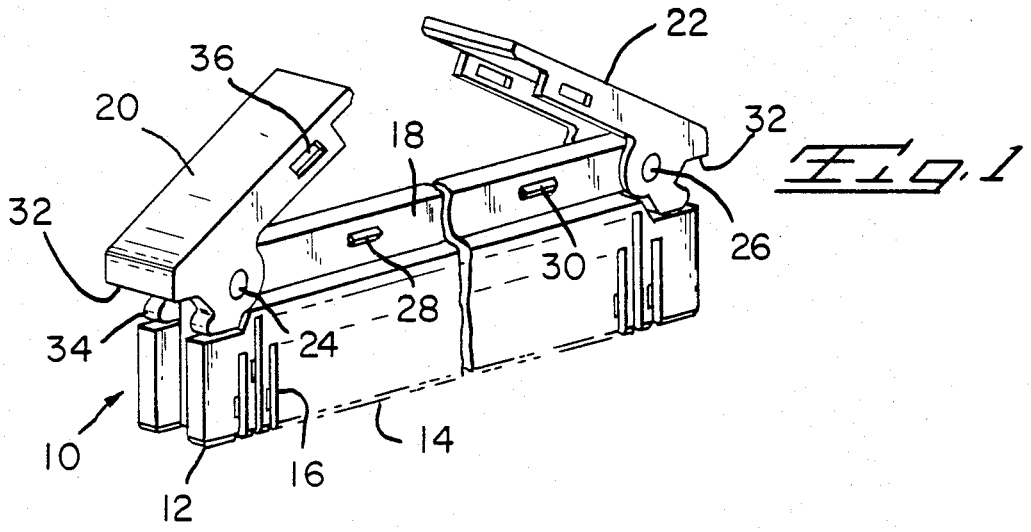

An embodiment of the present invention will now be described by way of example with reference to the accompanying drawings, in which:

FIG. 1 is a perspective view of a connector according to the present invention provided with a latching and ejecting mechanism.

Figure 2:
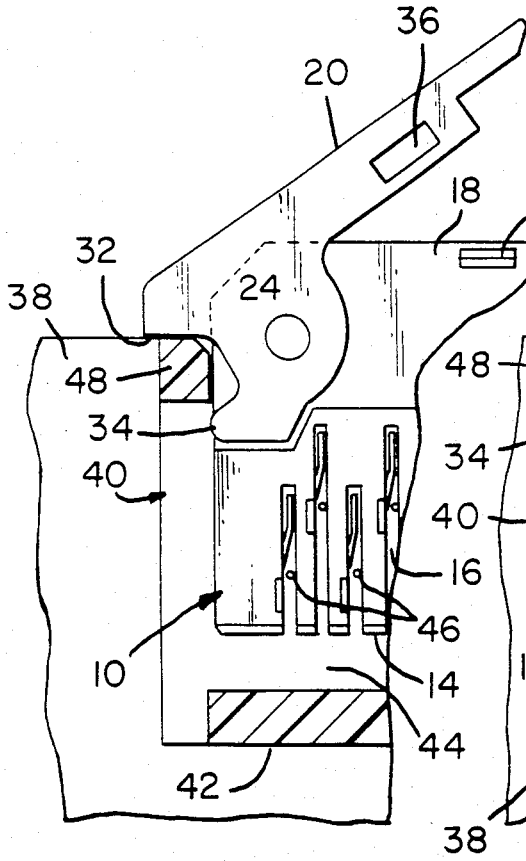
Figure 3:
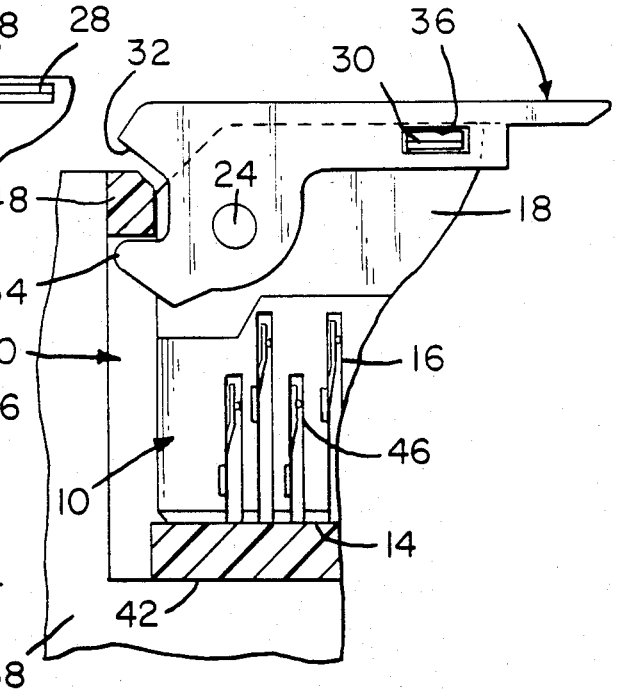
Figure 1A:
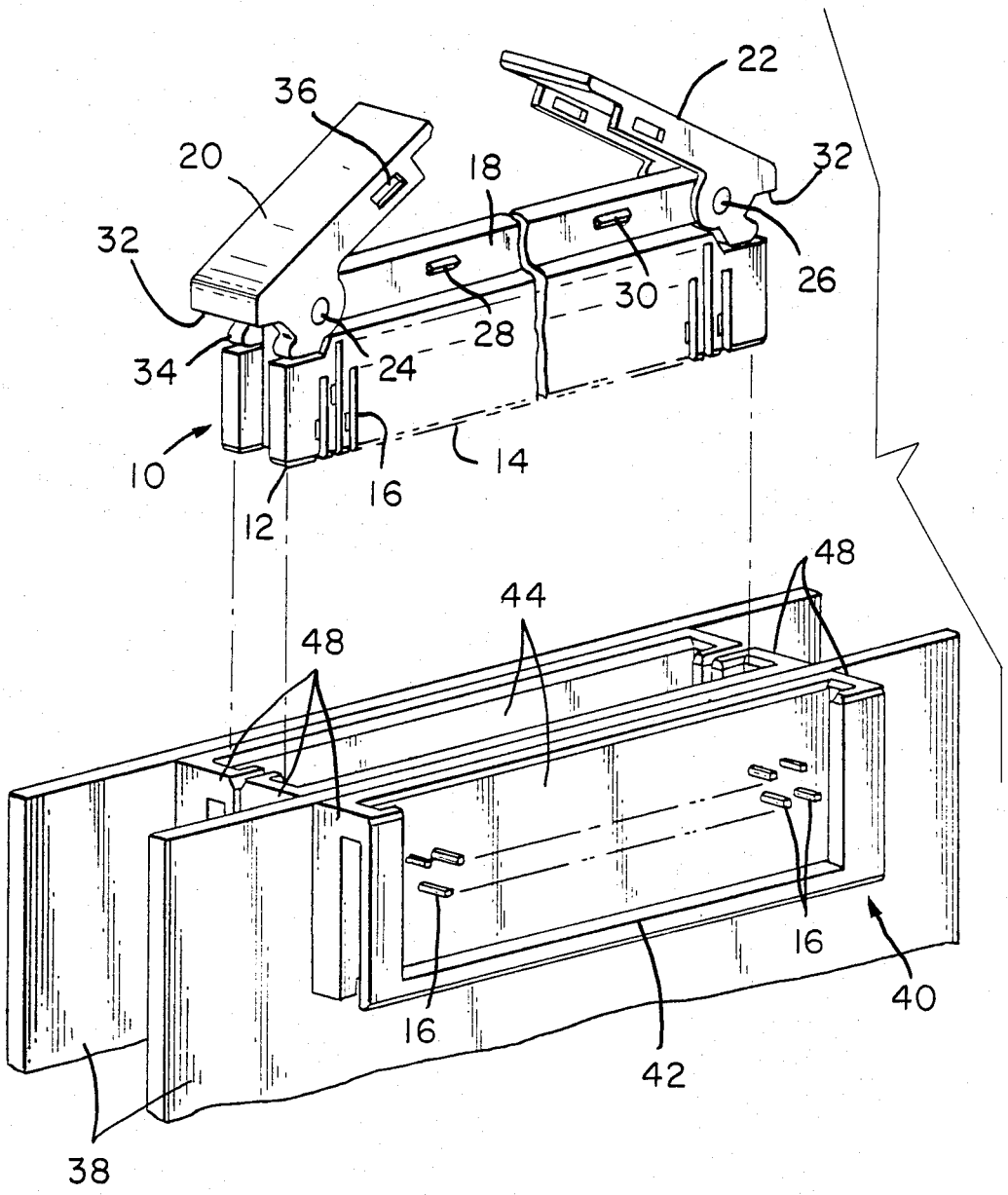

FIG. 1*a* is a perspective view in exploded form of the connector, the headers and the circuit boards associated therewith;

FIG. 2 is an end view, partially in section, of the connector of FIG. 1 and the header of FIG. 1*a* in an unlatched condition; and FIG. 3 is a view similar to FIG. 2 showing the connector in a latched condition.

The connector 10 shown in FIGS. 1 to 3 is of a known type, such as that of U.S. Pat. No. 4,384,754, the disclosure of which is incorporated herein by reference. The connector 10 is designed for making a interconnection with pin terminals mounted in a high density array in headers on closely adjacent circuit boards. The connector 10 has an elongated housing 12 (shown as a pair in FIGS. 1 and 1*a*) of rigid insulative material having a mating face 14 with a plurality of parallel spaced transverse slots 16 extending into the housing normal to the mating face. The housing has an integral dorsal rib 18 extending longitudinally of the housing with latching members 20, 22 mounted at opposite ends by respective pivot pins 24, 26. The dorsal rib 18 also includes integral latching lugs 28, 30 on each side thereof. Each of the latching members 20, 22 has, on the free end thereof, a first shoulder 32 and a pair of spaced second shoulders 34 opposing but spaced from the respective first shoulder 32. Each latching member 20, 22 further has an aperture 36 positioned to receive a respective lug 28, 30.

According to FIG. 1*a* each circuit board 38 has at least one pin header 40 mounted along an edge portion. Each pin header 40 has a housing 42 of rigid insulative material having a mating cavity 44 into which an array of circuit board contacting pin terminals 46 extend. For each header 40 a pair of ribs 48 are shown for cooperation with respective ones of the pair of spaced shoulders 34, to be more fully explained below.

It will be appreciated from FIGS. 2 and 3 (where only one of the ribs 48 is shown) that the latching members 20, 22 must first be rotated to a position freeing the second shoulders 34 from engagement under the rib 48 of the pin header 40 and that rotational movement of the latching members will bring the shoulders 34 into engagement with the rib 48 driving the connector 10 into mating position in the header 40. When the latching member 20,22 is fully rotated against the dorsal rib 18, the lugs 28, 30 will engage the respective apertures 36 to secure the latching members against accidental movement.

When it is desired to extract the connector 10 from the header 40, it is only necessary to apply a counter rotational force to the latching members 20, 22 to bring the shoulders 32 into engagement with the top of the ribs 48 while freeing the second shoulders 34 from the bottom of the ribs 48. The first shoulder engagement cams the connector 10 from the header 40 to effect the desired extraction.

We claim:

1. In a multi plane connector system having header assemblies mounted on respective circuit boards, each header assembly having an elongated header housing of rigid insulative material containing an array of pin terminals each engaging circuitry of the respective circuit board and having an end portion exposed from a mating surface of said housing, at least one rib at each end of said header housing, connector members adapted to mate with header assemblies on adjacent pairs of circuit boards, each connector member having an elongated housing of rigid insulative material containing an array of terminals each adapted to mate with a respective pair of said pin terminals extending from said mating surfaces of headers on said adjacent circuit boards, and a releasable latching means comprising:

a pair of arm members each pivotally attached at a respective end of said connector, each arm member having first and second parallel spaced shoulders directed toward the adjacent end of said connector and each adapted to engage a respective side of said rib of said header housing, whereby rotation of said arm member causes at least one of said shoulders to be biased against said respective side of said rib, thereby camming the connector in a desired direction.

2. The multi plane connector system according to claim 1 further comprising, a dorsal fin on said connector member housing, said arm members having means for being pivotally mounted on said fin.

3. The multi plane connector system according to claim 2 further comprising, at least one pair of lugs on said fin spaced from said pivotally mounted means, and apertures in said arm members alinged to receive said lugs, whereby said arm members can be latched in position.

4. In a multi plane connector system having a releasable latching means for inserting and withdrawing a connector with respect to a pair of closely spaced headers, the connector being located between and electrically interconnecting said pair of spaced headers, each header having an elongated housing of insulative material containing an array of pin terminals extending from adjacent circuit boards, a latching rib at each end of said housing, and said releasable latching means comprising a pair of elongated arm members each pivotally attached at a respective end of a connector housing, each arm member having a pair of parallel spaced shoulders directed towards said respective end and each adapted to engage a respective side of said header housing rib at each end of said housing, whereby rotation of said arm members cams said connector in a desired direction.

5. A multi plane connector system having header assemblies mounted on respective circuit boards, each header assembly having an elongated header housing of rigid insulative material containing an array of pin terminals each engaging circuitry of one of said respective circuit boards and having an end portion exposed from a mating surface of said housing, at least one rib at each end of said header housing, connector members adapted to mate with header assemblies on adjacent pairs of said circuit boards, each connector member having an elongated housing of rigid insulative material containing an array of terminals each adapted to mate with a respective pair of pin terminals extending from said mating surfaces of headers on adjacent ones of said circuit boards, and a releasable latching means comprising, a pair of arm members each pivotally attached at a respective end of said connector, each arm member having first and second parallel spaced shoulders directed toward the adjacent end of said connector and adapted to engage a respective side of said rib on said header housing, whereby rotation of said arm members causes at least one of said shoulders to be biased against said respective side of said rib, thereby camming said connector in a desired direction.

6. The multi plane connector system according to claim 5 further comprising a dorsal fin on said connector member housing, said arm members having means for being pivotally mounted on said fin.

7. The multi plane connector system according to claim 5 further characterized by at least one pair of lugs on said fin spaced from said pivotally mounted means, and apertures in said arm members aligned to receive said lugs, whereby said arm members can be latched into position.

8. A multi plane connector system having a releasable latching means for inserting and withdrawing a connector with respect to a pair of spaced headers, the connector being located between and electrically interconnecting said pair of closely spaced headers, said spaced headers each having a housing containing a pin terminal means extending from adjacent circuit boards, a latching rib means on at least one end of said housing, and said releasable latching means comprising at least one elongated arm member pivotally mounted near a respective end of said connector, said arm member having at least one shoulder directed towards said respective end and adapted to engage a respective side of said latching rib means, whereby rotation of said arm member cams said connector in a desired direction.

* * * * *